US006269571B1

(12) United States Patent
Thalenfeld

(10) Patent No.: US 6,269,571 B1
(45) Date of Patent: Aug. 7, 2001

(54) DUAL PURPOSE LABEL HOLDER ADAPTED FOR MOUNTING ON A CROSS BAR OR MOUNTING PLATE OF A MERCHANDISE DISPLAY HOOK

(75) Inventor: David R. Thalenfeld, Bear Creek, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 09/122,212

(22) Filed: Jul. 24, 1998

(51) Int. Cl.[7] ..... G09F 3/00

(52) U.S. Cl. ..... 40/642.01; 40/666; 211/57.1; 211/59.1; 248/214; 248/231.81

(58) Field of Search ..... 40/642.01, 642.02, 40/649, 651, 658, 661.03, 661.08, 666; 211/57.1, 59.1; 248/214, 223.41, 224.51, 231.81

(56) References Cited

U.S. PATENT DOCUMENTS

| | | | | |
|---|---|---|---|---|
| 1,704,562 | * | 3/1929 | Egan | 40/658 X |
| 2,206,522 | * | 7/1940 | Varon | 40/658 |
| 3,248,765 | * | 5/1966 | Achabal et al. | 211/57.1 X |
| 4,405,051 | | 9/1983 | Thalenfeld . | |
| 4,718,626 | * | 1/1988 | Thalenfeld et al. | 40/642.01 X |
| 5,348,167 | | 9/1994 | Jensen . | |
| 5,442,872 | | 8/1995 | Moser . | |
| 5,456,034 | | 10/1995 | Lewis et al. . | |
| 5,488,793 | * | 2/1996 | Gebka et al. | 40/649 X |
| 5,645,175 | | 7/1997 | Wood . | |
| 5,702,008 | * | 12/1997 | Thalenfeld et al. | 211/57.1 |
| 5,815,970 | * | 10/1998 | Thalenfeld et al. | 40/642.01 |
| 5,826,359 | * | 10/1998 | Thalenfeld et al. | 40/642.01 |
| 5,860,239 | * | 1/1999 | Thalenfeld et al. | 40/642.01 |
| 5,901,487 | * | 5/1999 | Thalenfeld et al. | 40/642.01 |
| 5,941,003 | * | 8/1999 | Thalenfeld | 40/642.01 |
| 5,967,343 | * | 10/1999 | Dufresne | 211/86.01 |

* cited by examiner

*Primary Examiner*—Anthony Knight
*Assistant Examiner*—Andrea Chop
(74) *Attorney, Agent, or Firm*—Schweitzer Cornman Gross & Bondell LLP

(57) ABSTRACT

A dual purpose label holder for mounting on a merchandise display hook having label support means in the form of a cross bar or mounting plate fixedly attached to the outward end of a label holder arm. The label holder is formed of plastic and has a back panel formed with upper and lower mounting portions for pivotal attachment to a cross bar or fixed attachment to a mounting plate. The upper mounting portions serves in a dual capacity, either for pivotal engagement with a cross bar or for fixed engagement with the upper edge of a mounting plate. The label holder preferably has flexibly connected front and back panels, opening at the top, for receiving printed information labels.

5 Claims, 5 Drawing Sheets

DUAL PURPOSE LABEL HOLDER ADAPTED FOR MOUNTING ON A CROSS BAR OR MOUNTING PLATE OF A MERCHANDISE DISPLAY HOOK

BACKGROUND AND SUMMARY OF THE INVENTION

Display hooks, typically mounted on apertured panel board, slotted panels or the like are in widespread usage for displaying carded merchandise for sale. In many cases, such merchandise display hooks are combined with label-mounting means for presenting product information and pricing in association with the carded merchandise. A common form of such label-mounting means consists of a label holder arm projecting above and generally parallel to a merchandise supporting arm and mounting a label-holding device at its forward extremity, advantageously in a position directly in front of the outer end of the merchandise supporting arm. The label-holding device, in such cases, serves an additional function as a means for guarding the outer end of the display hook element against accidental contact.

One advantageous type of label-mounting means for this purpose, which has been recently introduced to the market place, comprises a wire-like label holder arm extending outward, above the merchandise support arm, and terminating at its outer extremity in a cylindrical cross bar element. The cross bar element serves as a pivoting support for a plastic label holder, allowing the label holder to hang downward in front of the outer end of the merchandise support arm. The pivoting action of the label holder facilitates product removal from the associated product support. If a product being withdrawn forwardly from its display hook engages the plastic label holder, the holder can simply pivot upward out of the way as necessary to allow the product to clear. An additional advantage of pivoting label holders in general is that, with respect to product items displayed at a low level, viewing of the product information and pricing is facilitated by allowing the customer to simply reach down and tilt the label holder upwardly, rather than having to bend or crouch to read the contents of the label.

A particularly advantageous form of label holder used with the above described pivotal mounting, is a plastic extrusion having front and back panels, joined along their bottom edges to form a label pocket open along the top and sides. At least the front panel is of transparent material. The panels are joined in such a way that the front panel tends to press rearwardly against the back panel to lightly grip a printed paper information label placed in the label pocket. These new label holders have become very popular because they enable the use of inexpensive plain paper labels. Principally, the above described label holders have been used with the above described hooks, providing a flip-up mounting. However, merchandisers have an installed base of many, many millions of display hooks designed for fixed label mounting. In a widely used such label mounting means, a wire-like element terminates at its outer extremity with a welded-on, substantially vertically aligned mounting plate. The plate serves as a support to rigidly mount a different type of plastic label holder which is designed to be installed laterally (i.e., from the side) or vertically, from the top.

The present invention is directed to a merchandise display hooks of the general types described above, including an inexpensive, improved, dual purpose label holder, which is designed to be mounted on either type of label holder arm, whether it has a cross bar for pivotal mounting or a mounting plate. To this end, the label holder of the invention includes an upper mounting portion designed to engage either a cross bar, for pivotal support of the label holder solely by the cross bar, or to mount on an upper edge of a mounting plate for fixed support on the label holder arm having a mounting plate. The label holder also includes a lower mounting portion designed to engage a lower edge of the mounting plate. Thus, a single type of label holder can be manufactured, inventoried and installed on either type of the above-described holder means. The novel design modification of the present invention requires only an insignificant increase in manufacturing expense, and results in substantial savings in distribution, inventory, installation and modifications.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
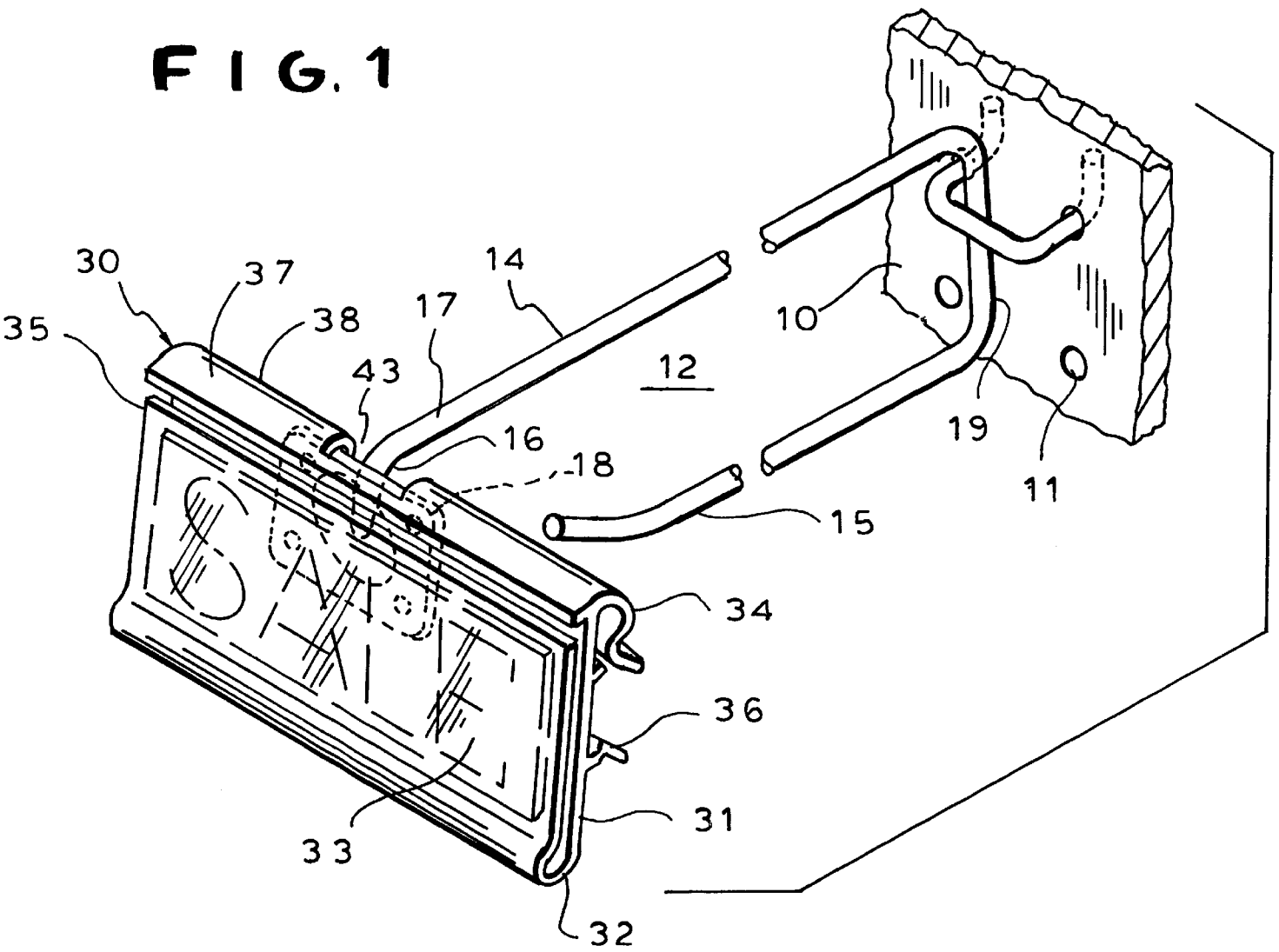
FIG. 1 is a perspective view of the merchandise hook of the present invention, illustrating the label holder mounted in fixed position on a mounting plate.
Figure 2:
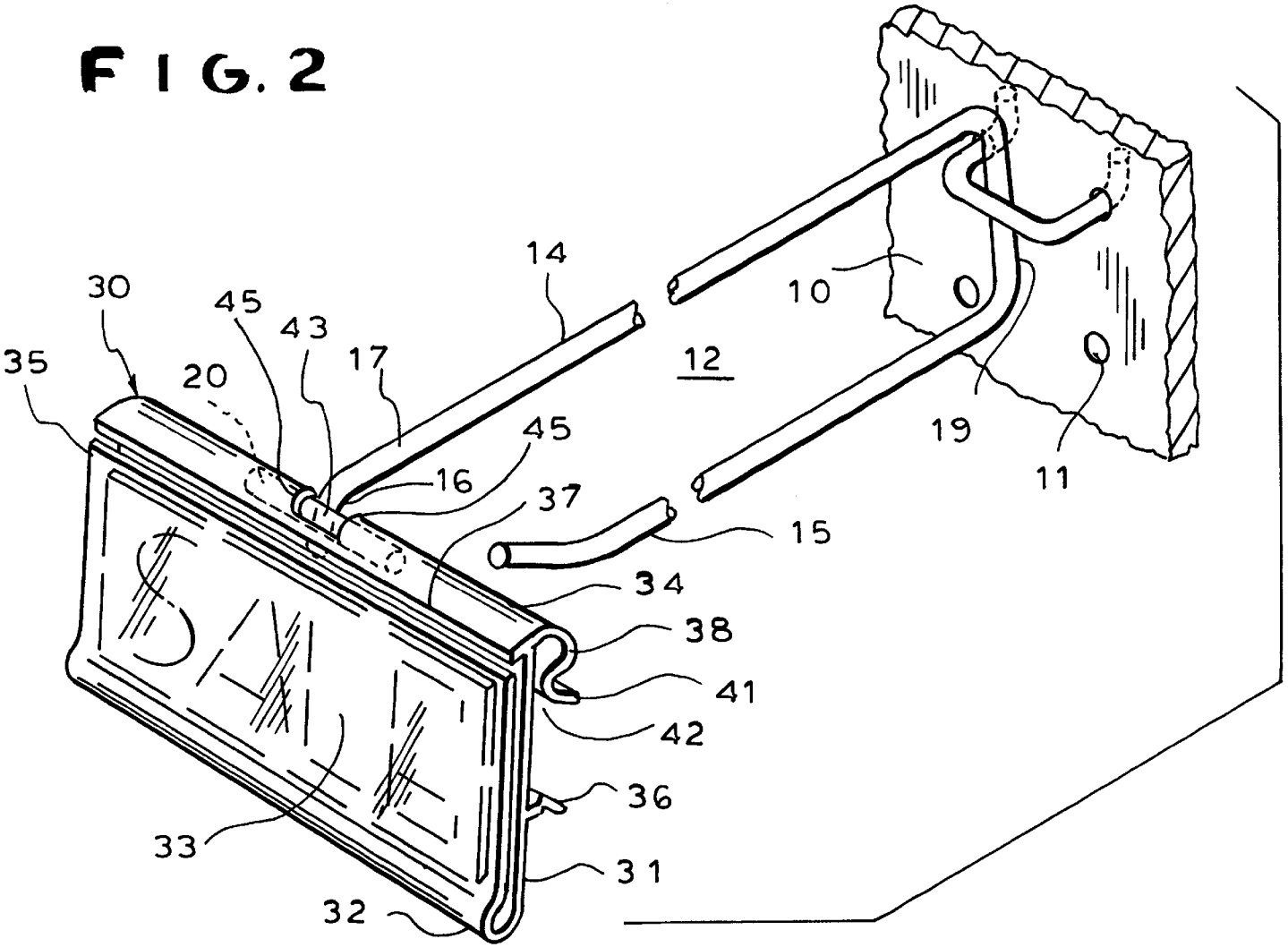
FIG. 2 is a perspective view of the merchandise hook of the present invention, illustrating the label holder mounted on a cross bar for pivoting action.

Referring now to the drawings and specifically to FIGS. 1 and 2 thereof, the reference numeral 10 designates a section of apertured panel board provided with a grid of openings 11. Conventionally, the openings 11 are provided over the entire surface of the panel 10 and are spaced uniformly, both horizontally and vertically. A merchandise display hook 12 is conventionally provided with mounting lugs which are inserted through an adjacent pair of apertures 11 in the board 10 in order to support the merchandise hook 12 in the manner illustrated, with operative portions of the display hook extending outward from the face of the panel board.

The merchandise display hook 12 includes a label holder arm 14 and a merchandise support arm 15 preferably integrally joined by a connecting portion 19. Preferably, the label holder arm 14 includes a downwardly turned portion 16 at the outer end 17 thereof for attachment of a label holder support means such as the mounting plate 18 (FIG. 1) or cross bar 20 (FIG. 2).

Mounted on the mounting plate 18 or cross bar 20 is a plastic label holder, generally designated by the reference numeral 30. The label holder 30 is of an integrally extruded or coextruded, semi-rigid plastic construction and comprises a back panel 31 joined along a bottom edge 32 with a preferably clear front panel 33. The front and back panels 33, 31 and the bottom edge 32 are so arranged that the front panel tends to close elastically against the front face of the back panel 31. However, by pressing rearwardly against the bottom portion 32 the upper lip 35 of the front panel can be sprung forward from the back panel 31 to accommodate the placement and retrieval of product information and pricing labels.

Figure 3:
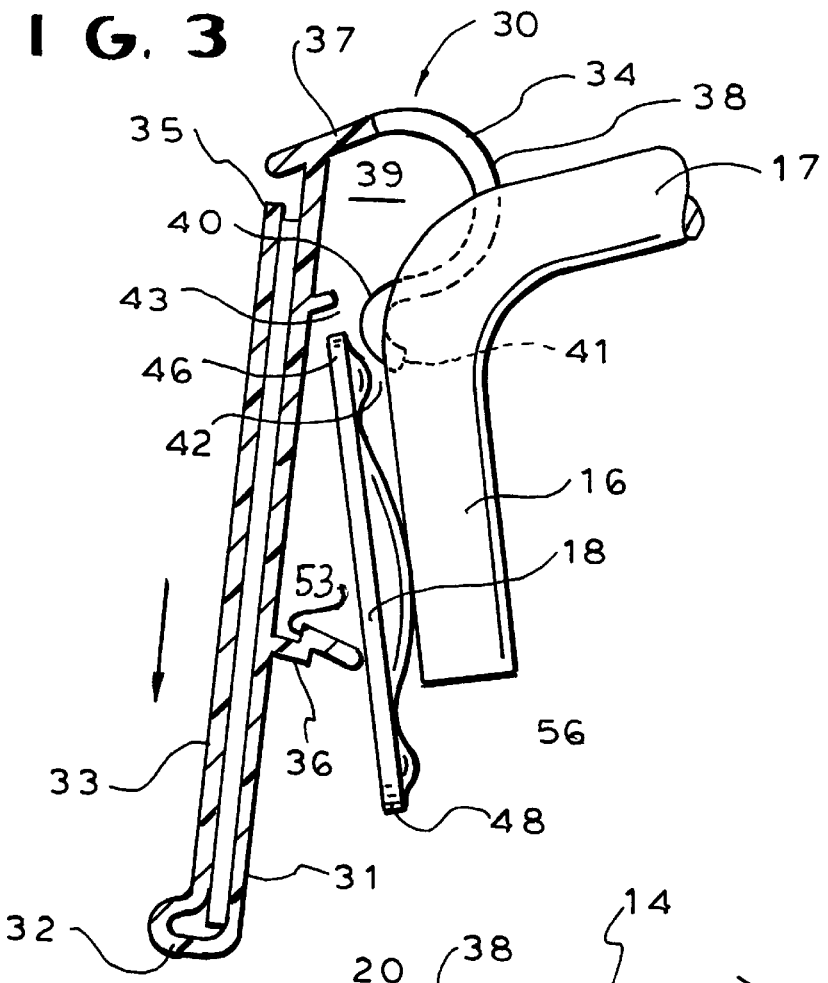
FIGS. 3, 4 and 5 are cross sectional side elevational views of the merchandise hook of FIG. 1, illustrating the procedure for installing the label holder on a fixed mounting plate.
Figure 7:
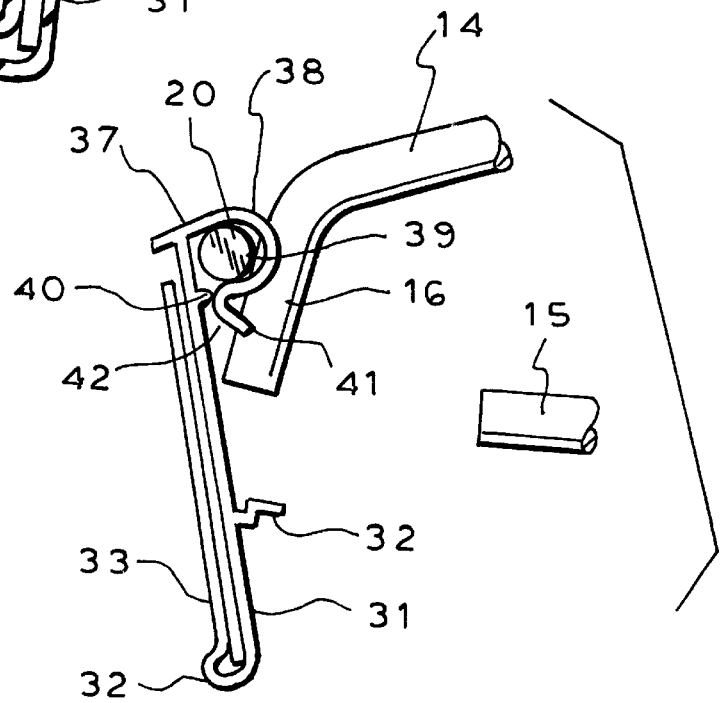
FIG. 7 is a side elevational view of the merchandise display hook of FIG. 2 with a label holder mounted for pivoting action.
Figure 5:
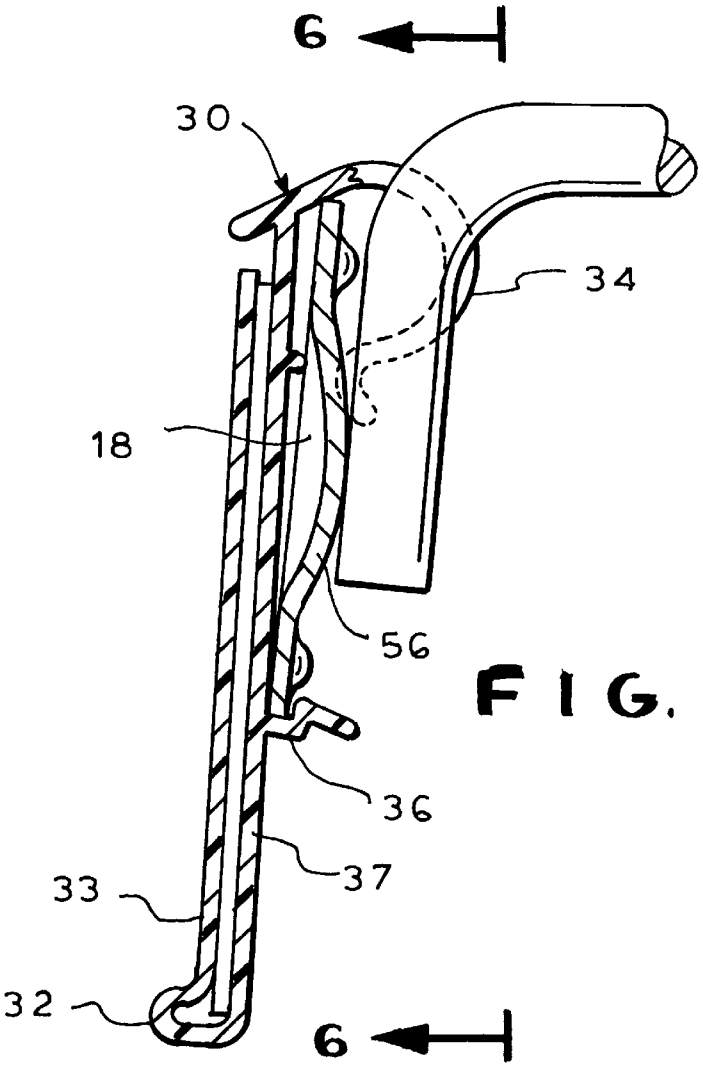

Referring to FIGS. 3 and 7, the label holder 30 includes an upper mounting portion 34 for engagement of the upper edge of a mounting plate 18 or a cross bar 20, and includes a lower mounting portion 36 for engagement with the lower edge of a mounting plate 18. The upper mounting portion 34 includes a hinge-forming flange 37 which projects rearwardly from the upper edge of the back panel 31 and a forwardly-facing, substantially U-shaped retaining clip portion 38 defining a recess 39 of a size to rotatably (i.e., loosely) pivotally receive the cross bar element 20. At its lower edge extremity 40, the U-shaped retaining clip portion 38 supports a downwardly and rearwardly diverging guide flange 41. The guide flange 41 is angled downwardly preferably at about 45 degrees with respect to the plane of the back panel 31 and extends for a sufficient distance to provide a relatively wide entrance 42 to guide the cross bar 20 through the narrow entry gap 43 formed between the back panel 31 and the lower edge extremity 40 of the U-shaped retaining clip portion. Thus, by placing the guide flange 41 in contact with the cross bar 20 and pressing downward on the top of the retaining flange 37, the lower portion of the retaining flange will be cammed open by the guide flange 41. As soon as the cross bar 20 enters the recess 39, the retaining flange 37 elastically closes to the position shown in FIG. 7 so that the label holder 30 is reliably connected to the cross bar 20 while being free to pivot with respect thereto. Also, as seen in FIGS. 1 and 2, the retaining clip portion 38 and the guide flange 41, are slotted at 43 in the center of the label holder, so that inner side edges 45 of the slot 43 straddle the wire outward end section 17, including the downwardly-turned portion 16, to accommodate upward pivoting of the label holer, and also to maintain the label holder properly centered with respect to the label support arm 14.

Referring to FIGS. 1 and 3–6, the upper mounting portion 34 can be mounted over an upper edge 46 of a standard mounting plate 18, with the mounting plate 18 passing through the narrow entry gap 43 between the back panel 31 and the lower edge extremity 40 of the retaining clip portion 38. Thus, as shown in FIG. 3, the label holder 30 can be urged downwardly over the mounting plate 18 until the upper edge 46 of the mounting plate contacts the hinge-forming flange 37 (i.e. the uppermost section of the upper mounting portion 34).

Figure 4:
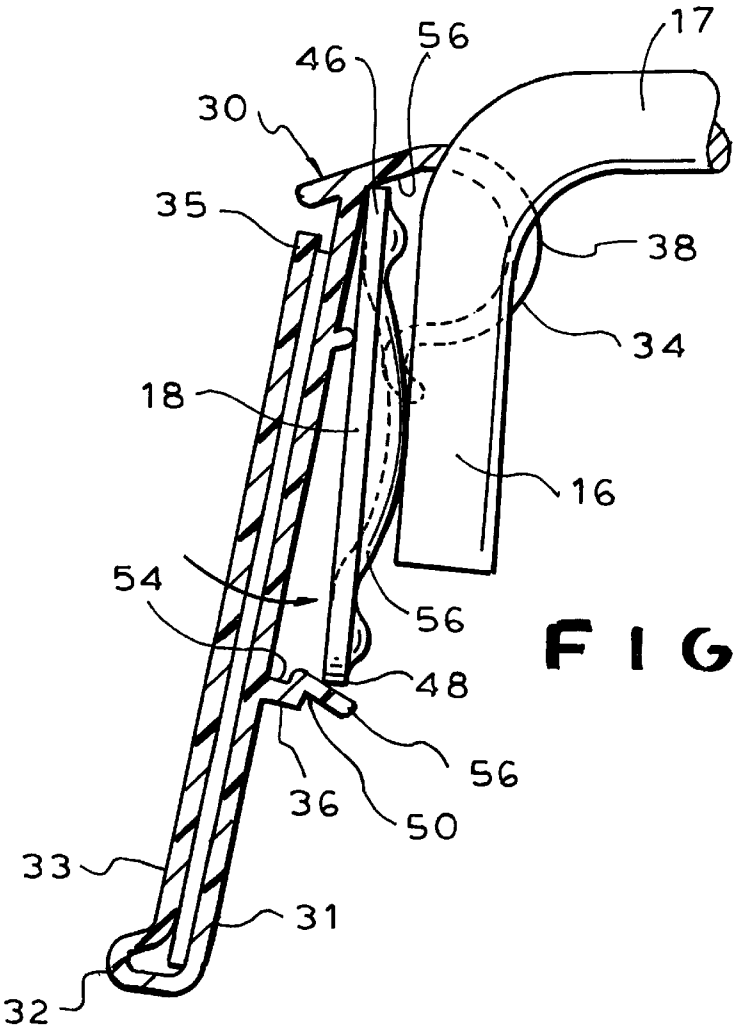

As best seen in FIG. 4, the lower mounting portion 36 of the label holder 30 comprises a resilient mounting clip 50, which preferably extends across the length of the back panel 31 of the label holder 30, parallel to the retaining clip portion 38 and the hinge-forming flange 37. The mounting clip 50 is integrally formed with the label holder 30 and the back panel 31 thereof and includes a downwardly and rearwardly directed guide flange 52 extending from an outer wall 53 of the mounting clip 50. To engage the mounting clip 50 with the mounting plate 18, the label holder 30 is rotated toward the mounting plate such that the guide flange 52 of the mounting clip 50 engages the lower edge 48 of the mounting plate 18, deflecting the mounting clip 50 around the mounting plate 18.

The mounting clip 50 includes a channel 54, defined by the back panel 31 of the label holder and an outer wall 53 of the mounting clip 50, to receive the lower edge 48 of the mounting plate 18 when the label holder 30 is properly mounted. The distance between the channel 54 of the mounting clip 50 and the interior surface 56 of the hinge-forming flange portion 37 of the label holder 30 is preferably substantially equal to the distance between the lower and upper edges 48, 46 of the mounting plate 18 such that the label holder 30 is substantially restrained in a vertical direction.

In addition, the side edges 45 of the gap 43 of the retaining clip portion 38 straddle and confine the downwardly turned section 16 of the outward end 17 of the label holder arm 14 to restrain the movement of the label holder 30 in a lateral or horizontal direction.

Figure 6:
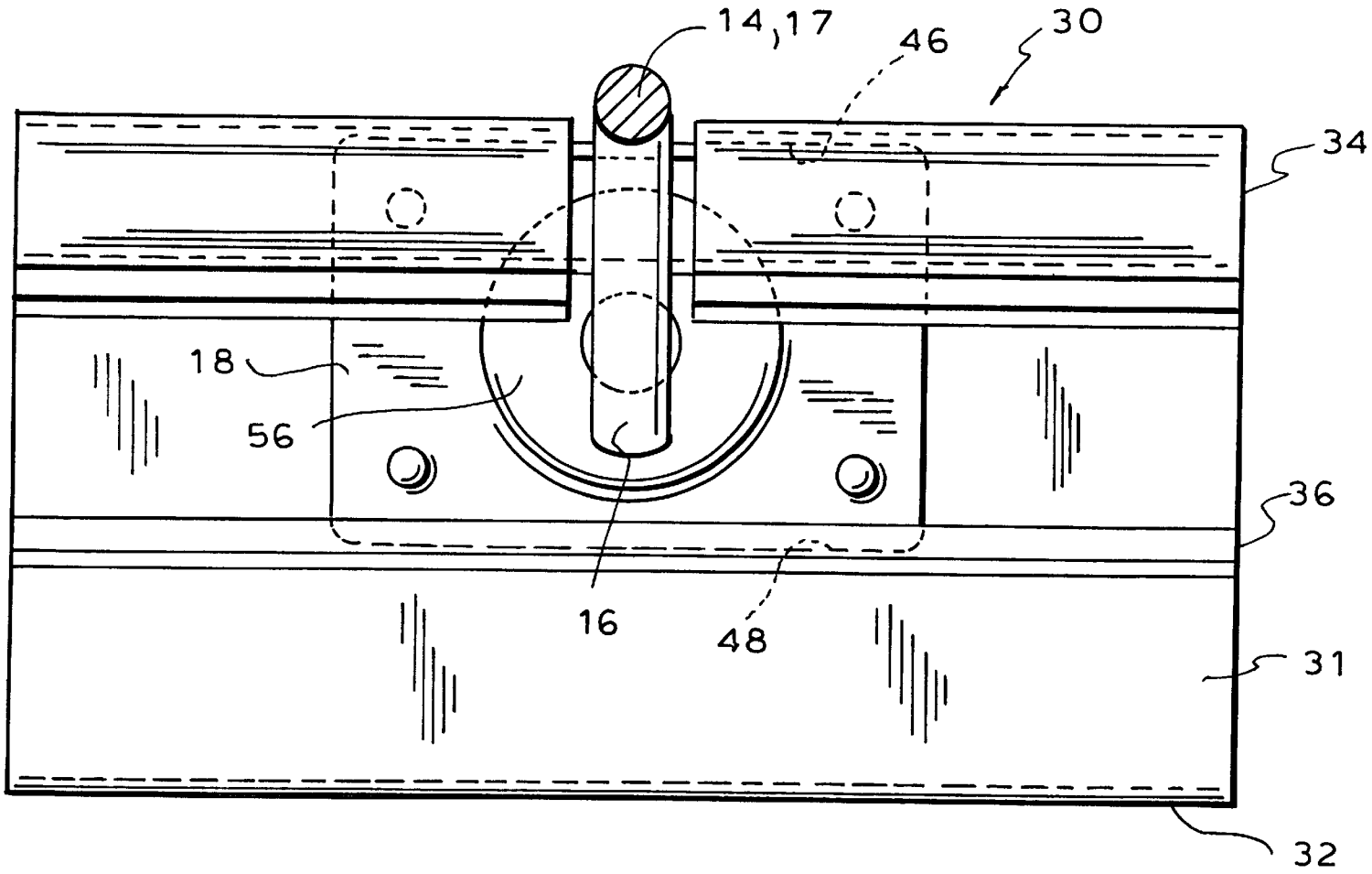
FIG. 6 is a rear elevational view taken generally along line 6—6 of FIG. 5.

As shown in FIGS. 1 and 6, a standard mounting plate 18 may include a semi-spherical projection 56 extending rearwardly for connection to the label support arm 14. The side edges 45 of the gap 43 of the retaining clip portion 38 are also preferably aligned to contact the semi-spherical projection 56 to maintain lateral alignment of the label holder 30.

The label holder 30 can be removed by reversing the above steps. Specifically, the bottom edge portion of the label holder 30 is urged outward thereby disengaging the mounting clip 50 from the lower edge 48 of the mounting plate 18. Then, the label holder 30 is urged upward such that the mounting clip portion 38 slides off and above the upper edge 46 of the mounting plate 18.

Production of the novel dual purpose label holder 30 with the mounting clip 50 requires an inconsequential increase in expense as compared to prior label holders having only a retaining clip portion. However, the present invention effectively provides a two-fold increase in the usefulness of the label holder 30 with a corresponding decrease in inventory and installation costs. Thus, the novel merchandise display hook and label holder provide significant advantages over prior designs.

Importantly, the dual purpose label holder enables a merchandiser, desiring to take advantage of the new flip-up style of hook and label holder to also utilize the same label holder in conjunction with its already huge installed base of conventional display hooks, provided with fixed mounting plates at their outer ends. The merchandiser may utilize a common style of label holder, without regard to whether it is to be installed on a hook designed for flip-up mounting of the holder, or whether the hook is of the widely used type with a fixed mounting plate. The merchandiser thus not only is unable to take full advantage of the benefits of the new style of label holder, and the convenience and cost benefits of utilizing plain paper labels therein, but also achieves a desired uniformity of appearance in the presentation of labels and label holders, even though the display hooks themselves may be of significantly different construction.

It should be understood, of course, that the specific form of the invention herein illustrated and described is intended to be representative only. In this respect, the specific form of the merchandise display hook employing the new label mounting feature may take any of a variety of forms. Likewise, the plastic label holder itself may be constructed in various ways consistent with the present invention. Accordingly, reference should be made to the following appended claims in determining the full scope of the invention.

I claim:

1. A merchandise display hook assembly, comprising:

(a) a label support arm and merchandise support arm, said label support arm including means alternatively in the form of a cross bar or a vertically oriented mounting plate attached to an outward end of said label support arm at right angles thereto for mounting a label holder;

(b) a dual purpose label holder having a back panel and having upper and lower mounting portions extending rearwardly from said back panel, said label holder being mounted on said label holder mounting means;

(c) said upper mounting portion of said label holder including a forwardly-facing, substantially U-shaped flexible retaining clip portion adapted alternatively to be pivotally mounted on a cross bar or to be fixedly mounted on an upper edge of a mounting plate, (d) said retaining clip portion and said back panel forming a narrow entry gap for reception of said label holder mounting means therethrough; and (e) said lower mounting portion comprising a mounting clip extending rearwardly from said back panel substantially parallel to and spaced downwardly from said retaining clip portion and forming an upwardly-facing channel engageable with lower edge portions of a mounting plate;

(f) said mounting clip having a guide flange extending rearwardly and downwardly from an upper edge thereof for deflecting said mounting clip around lower edge portions of a mounting plate, when said retaining clip is mounted upon an upper edge of a mounting plate, upon rearward pivoting movement of said label holder about such upper edge of such mounting plate;

(g) said label holder being alternatively pivotally mounted on said label support arm solely by said upper mounting portion if said label holder mounting means comprises a cross bar or being fixedly mounted to said label support arm by both said upper and lower mounting portions if said label holder mounting means comprises a mounting plate.

2. A merchandise display hook assembly as in claim 1, wherein (a) said label holder mounting means comprises a mounting plate fixedly connected to the outward end of said label support arm, said mounting plate having upper and lower edges;

(b) said upper mounting portion of said label holder extends over said upper edge of said mounting plate; and (c) said lower edge of said mounting plate is seated within said channel of said lower mounting portion.

3. A merchandise display hook assembly as in claim 2, wherein a distance between said upper mounting portion of said label holder and said channel of said lower mounting portion is substantially equal to a distance between said upper and lower edges of said mounting plate such that vertical movement of said label holder is substantially restrained.

4. A merchandise display hook assembly, comprising:

(a) a label support arm and merchandise support arm, said label support arm including means alternatively in the form of a cross bar or a vertically oriented mounting plate attached to an outward end of said label support arm at right angles thereto for mounting a label holder;

(b) a dual purpose label holder having a back panel and having upper and lower mounting portions extending rearwardly from said back panel, said label holder being mounted on said label holder mounting means;

(c) said upper mounting portion of said label holder including a forwardly-facing, substantially U-shaped retaining clip portion adapted alternatively to be pivotally mounted on a cross bar or to be fixedly mounted on an upper edge of a mounting plate, (d) said retaining clip portion and said back panel forming a narrow entry gap for reception of said label holder mounting means therethrough;

(e) said lower mounting portion comprising a mounting clip extending rearwardly from said back panel substantially parallel to said retaining clip portion and forming an upwardly-facing channel engageable with lower edge portions of a mounting plate;

(f) said label holder being alternatively pivotally mounted on said label support arm solely by said upper mounting portion if said label holder mounting means comprises a cross bar or being fixedly mounted to said label support arm by both said upper and lower mounting portions if said label holder mounting means comprises a mounting plate;

(g) said label holder mounting means comprising a mounting plate fixedly connected to the outward end of said label support arm, said mounting plate having upper and lower edges;

(h) said upper mounting portion of said label holder extending over said upper edge of said mounting plate;

(i) said lower edge of said mounting plate being seated within said channel of said lower mounting portion;

(j) a distance between said upper mounting portion of said label holder and said channel of said lower mounting portion being substantially equal to a distance between said upper and lower edges of said mounting plate such that vertical movement of said label holder is substantially restrained; and (k) said retaining clip portion including an alignment gap with two opposed side edges to accommodate said outward end of said label support arm, said side edges of said gap serving to restrain lateral movement of said label holder with respect to said label support arm.

5. A merchandise display hook assembly as in claim 4, wherein:

(a) said mounting plate further comprises a central, rearwardly-extending projection connecting said mounting plate to said label support arm;

(b) said side edges of said alignment gap contacting said projection to limit lateral movement of said label holder with respect to said label support arm.

* * * * *